US011482352B2

(12) United States Patent
Pera et al.

(10) Patent No.: US 11,482,352 B2
(45) Date of Patent: Oct. 25, 2022

(54) QUICK CONNECTING TWISTED PAIR CABLES

(71) Applicant: UBIQUITI INC., New York, NY (US)

(72) Inventors: Robert J. Pera, Seattle, WA (US); Yu-Hsuan Lai, Taipei (TW); Vladimir Vyskocil, Prague (CZ)

(73) Assignee: Ubiquiti Inc., New York, NY (US)

( * ) Notice: Subject to any disclaimer, the term of this patent is extended or adjusted under 35 U.S.C. 154(b) by 0 days.

(21) Appl. No.: 16/961,016

(22) PCT Filed: Jan. 9, 2019

(86) PCT No.: PCT/US2019/012910

§ 371 (c)(1),
(2) Date: Jul. 9, 2020

(87) PCT Pub. No.: WO2019/139993

PCT Pub. Date: Jul. 18, 2019

(65) Prior Publication Data

US 2021/0065933 A1 Mar. 4, 2021

Related U.S. Application Data

(60) Provisional application No. 62/682,773, filed on Jun. 8, 2018, provisional application No. 62/615,378, filed on Jan. 9, 2018.

(51) Int. Cl.

| | |
|---|---|
| ***H01B 11/12*** | (2006.01) |
| ***H01R 13/6463*** | (2011.01) |
| ***H01R 24/64*** | (2011.01) |

(52) U.S. Cl.
CPC ..... *H01B 11/125* (2013.01); *H01R 13/6463* (2013.01); *H01R 24/64* (2013.01)

(58) Field of Classification Search
CPC ... H01B 11/125; H01R 13/6483; H01R 24/64
USPC ..... 439/296
See application file for complete search history.

(56) References Cited

U.S. PATENT DOCUMENTS 4,527,451 A * 7/1985 Davis ..... H02G 1/1295 83/924
4,764,939 A * 8/1988 Rogers ..... H04L 25/45 375/259
5,010,642 A * 4/1991 Takahashi ..... H01B 13/01254 29/745

(Continued)

FOREIGN PATENT DOCUMENTS

JP 2014093173 A 5/2014
WO WO98/40990 A1 9/1998

(Continued)

*Primary Examiner* — Alexander Gilman
(74) *Attorney, Agent, or Firm* — Shay Glenn LLP

(57) ABSTRACT

Described herein are quick-connect twisted pair cables, cable systems and methods of installing/connecting them. For example, a quick-connect twisted pair cable may include a plurality of pairs of insulated wires within an outer insulating cover; within the insulating cover each of the plurality of pairs of insulated wires are wrapped around each other within elongate tubular body regions, and unwrapped (e.g., parallel) in flattened regions between the elongate tubular body regions. A quick plug connector may be configured as a standard (e.g., RJ-45) connector type.

18 Claims, 10 Drawing Sheets

(56) References Cited

U.S. PATENT DOCUMENTS 5,131,006 A 7/1992 Kamerman et al.
5,151,920 A 9/1992 Haagh et al.
5,295,154 A 3/1994 Meier et al.
5,406,260 A 4/1995 Cummings et al.
5,422,887 A 6/1995 Diepstraten et al.
5,428,636 A 6/1995 Meier
5,435,029 A * 7/1995 Carlson, Jr. ..... H02G 1/1292 140/123
5,481,794 A * 1/1996 Fischer ..... H05K 13/0478 198/750.12
5,504,746 A 4/1996 Meier
5,546,397 A 8/1996 Mahany
5,549,021 A * 8/1996 Bower, Jr. ..... H02G 1/1295 81/9.51
5,606,151 A * 2/1997 Siekierka ..... H01B 11/002 174/128.1
5,706,428 A 1/1998 Boer et al.
5,740,366 A 4/1998 Mahany et al.
5,844,893 A 12/1998 Gollnick et al.
5,893,302 A * 4/1999 Strom ..... G02B 6/245 81/9.41
5,936,542 A 8/1999 Kleinrock
5,940,771 A 8/1999 Gollnick et al.
6,130,892 A 10/2000 Short et al.
6,194,992 B1 2/2001 Short et al.
6,247,230 B1 * 6/2001 Hart ..... H01R 43/015 29/566.4
6,337,990 B1 1/2002 Koshino
6,374,311 B1 4/2002 Mahany et al.
6,563,786 B1 5/2003 Nee
6,636,894 B1 10/2003 Short et al.
6,665,536 B1 12/2003 Mahany
6,697,415 B1 2/2004 Mahany
6,714,559 B1 3/2004 Meier
6,789,110 B1 9/2004 Short et al.
6,795,852 B1 9/2004 Kleinrock et al.
6,810,426 B2 10/2004 Mysore et al.
6,857,009 B1 2/2005 Ferreria et al.
6,868,399 B1 3/2005 Short et al.
7,020,082 B2 3/2006 Bhagavath et al.
7,073,245 B2 * 7/2006 Alexander ..... H01R 43/015 29/566.4
7,088,727 B1 8/2006 Short et al.
7,117,526 B1 10/2006 Short
7,194,554 B1 3/2007 Short et al.
7,197,556 B1 3/2007 Short et al.
7,229,309 B2 * 6/2007 Carroll ..... H01R 13/6463 439/418
7,231,224 B1 * 6/2007 Chesson ..... H04W 88/08 455/523
7,295,812 B2 11/2007 Haapoja et al.
7,386,002 B2 6/2008 Meier
7,413,478 B2 * 8/2008 Kleinschmidt ..... H01R 13/652 439/737
7,415,760 B2 * 8/2008 Elias ..... H01R 24/64 29/749
7,448,896 B2 * 11/2008 Malak ..... H01R 13/6272 439/352
7,457,646 B2 11/2008 Mahany et al.
7,739,383 B1 6/2010 Short et al.
7,752,334 B2 7/2010 Paunikar et al.
7,826,426 B1 11/2010 Bharghavan et al.
7,978,376 B2 * 7/2011 Divine ..... G06F 1/166 345/643
8,006,104 B1 * 8/2011 Sivertsen ..... G06F 1/18 174/53
8,077,113 B2 12/2011 Syed et al.
8,190,708 B1 5/2012 Short et al.
8,335,272 B2 12/2012 Roberts
8,449,326 B2 * 5/2013 Holland ..... H01R 13/11 439/578
8,483,188 B2 7/2013 Walton et al.
8,638,651 B2 * 1/2014 Michaelis ..... G01R 31/68 370/200
8,896,286 B2 * 11/2014 Abuelsaad ..... H01R 31/065 324/66
8,966,690 B2 * 3/2015 Stokes ..... H02G 1/1204 7/129
9,337,551 B2 * 5/2016 Uchida ..... H01R 4/185
9,391,440 B1 * 7/2016 Gardner ..... E04C 2/52
9,520,692 B2 * 12/2016 Valenti ..... H01R 13/447
9,774,142 B1 * 9/2017 Rust ..... H01R 13/717
9,870,773 B2 * 1/2018 German ..... G06F 3/167
9,923,288 B2 * 3/2018 Bertrand ..... H01R 13/111
10,050,389 B2 * 8/2018 Scherer ..... H01R 43/048
11,245,234 B2 * 2/2022 Lachelli ..... H01R 24/86
2005/0287873 A1 * 12/2005 Carroll ..... H01R 13/6463 439/676
2007/0259568 A1 * 11/2007 Mackillop ..... H01R 13/6477 439/638
2010/0328852 A1 * 12/2010 Johnson ..... H02G 3/00 439/345
2012/0282822 A1 * 11/2012 Elias ..... H01R 43/28 29/857
2018/0226743 A1 * 8/2018 Pepe ..... H01R 24/64
2020/0176932 A1 * 6/2020 Anderson ..... H01R 13/6463
2021/0065933 A1 * 3/2021 Pera ..... H01R 13/6463

FOREIGN PATENT DOCUMENTS

WO WO01/31855 A2 5/2001
WO WO01/31886 A2 5/2001
WO WO01/86877 A2 11/2001
WO WO2008/042804 A2 4/2008
WO WO2011/005710 A2 1/2011
WO WO2017/184323 A1 10/2017

* cited by examiner

EXISTING TWISTED PAIR CABLE

RJ-45 PLUG

ASSEMBLY DIFFICULTY

QUICK CONNECTING TWISTED PAIR CABLES

CROSS REFERENCE TO RELATED APPLICATIONS

This patient application claims priority to U.S. provisional patent application No. 62/615,378, filed on Jan. 9, 2018 (titled "QUICK CONNECTING TWISTED PAIR CABLES") and U.S. provisional patent application No. 62/682,773, filed on Jun. 8, 2018 (titled ("QUICK CONNECTING CABLES"), each of which is herein incorporated by reference in its entirety.

INCORPORATION BY REFERENCE

All publications and patent applications mentioned in this specification are herein incorporated by reference in their entirety to the same extent as if each individual publication or patent application was specifically and individually indicated to be incorporated by reference.

FIELD

Cable assemblies and comprising a cable having pairs of twisted conductors with regions at spaced intervals that are untwisted and adapted for snap connection to an adapted connector. These assemblies are configured to allow convenient connection without requiring a separate tool while reducing or eliminating electromagnetic cross-talk for high speed signal transmission. Also described herein are quick-connect cable assemblies are configured to allow convenient connection without requiring a separate tool while reducing or eliminating electromagnetic cross-talk for high speed signal transmission.

BACKGROUND

Twisted pair cabling is a type of wiring in which two conductors of a single circuit are twisted together for the purposes of canceling out electromagnetic interference from external sources; for instance, electromagnetic radiation from unshielded twisted pair (UTP) cables, and crosstalk between neighboring pairs.

The twist rate (also called pitch of the twist, usually defined in twists per meter) makes up part of the specification for a given type of cable. When nearby pairs have equal twist rates, the same conductors of the different pairs may repeatedly lie next to each other, partially undoing the benefits of differential mode. For this reason it is commonly specified that, at least for cables containing small numbers of pairs, the twist rates may differ. In contrast to shielded or foiled twisted pair (typically F/UTP or S/FTP cable shielding), UTP (unshielded twisted pair) cable is not surrounded by any shielding. UTP is the primary wire type for telephone usage and is very common for computer networking, especially as patch cables or temporary network connections due to the high flexibility of the cables. Unshielded twisted pair (UTP) cables are found in many Ethernet networks and telephone systems. For urban outdoor telephone cables containing hundreds or thousands of pairs, the cable may be divided into small but identical bundles. Each bundle consists of twisted pairs that have different twist rates. The bundles are in turn twisted together to make up the cable. Pairs having the same twist rate within the cable can still experience some degree of crosstalk. Wire pairs are selected carefully to minimize crosstalk within a large cable. UTP cable is also the most common cable used in computer networking. Modern Ethernet, the most common data networking standard, can use UTP cables. Twisted pair cabling is often used in data networks for short and medium length connections because of its relatively lower costs compared to optical fiber and coaxial cable. A solid-core cable uses one solid wire per conductor and in a four pair cable there would be a total of eight solid wires. Stranded conductor uses multiple wires wrapped around each other in each conductor and in a four pair with seven strands per conductor cable, there would be a total of 56 wires (2 per pair×4 pairs×7 strands). Solid core cable is intended for permanently installed runs. It is less flexible than stranded cable and is more prone to failure if repeatedly flexed. Stranded cable is used for fly leads at patch panel and for connections from wall-ports to end devices, as it resists cracking of the conductors.

Connectors are designed differently for solid core than for stranded. Use of a connector with the wrong cable type can lead to unreliable cabling. Plugs designed for solid and stranded core are readily available, and some vendors even offer plugs designed for use with both types. The punch-down blocks on patch-panel and wall-port jacks are designed for use with solid core cable.

Twisted pair's susceptibility to electromagnetic interference greatly depends on the pair twisting schemes (sometimes patented by the manufacturers) staying intact during the installation. As a result, twisted pair cables usually have stringent requirements for maximum pulling tension as well as minimum bend radius. This fragility of twisted pair cables makes the installation practices an important part of ensuring the cable's performance. Different pairs within the cable may have different delays, due to different twist rates used to minimize crosstalk between the pairs. This can degrade image quality when multiple pairs are used to carry components of a video signal. Differences between the two wires in a pair may also cause coupling between the common mode and the differential mode. Differential to common mode conversion produces common mode currents that can cause external interference and can produce common mode signals in other pairs. Common mode to differential mode conversion can produce differential mode signals from common mode interference from other pairs or external sources. Imbalance can be caused by asymmetry between the two conductors of the pair from each other and in relationship to other wires and the shield. Some sources of asymmetry are differences in conductor diameter and insulation thickness. In telephone jargon, the common mode is called longitudinal and the differential mode is called metallic.

One variant of twist a standard ribbon cable is twisted ribbon cable, in which adjacent pairs of conductors are bonded and twisted together. The twisted pairs are then lightly bonded to each other in a ribbon format. Periodically along the ribbon there are short sections with no twisting to enable connectors and PCB headers to be terminated using the usual ribbon cable IDC techniques.

In general, there is an increase in demand for cable and connection systems to transmit digital signals at high speeds. However, connecting to existing twisted cables is time consuming and requires multiple steps. It would be beneficial to provide twisted-cabling systems that allow for quick and easy connection to a connector, e.g., such as an RS-232 cable connector or any other connector.

In addition, there is an increase in demand for cable and connection systems to transmit digital signals at high speeds. However, connecting to existing cables, such as twisted cables, is time consuming and requires multiple steps. It would be beneficial to provide cabling systems that allow for quick and easy connection to a connector.

Described herein are apparatuses (including systems and devices) and methods of using them that address these needs.

SUMMARY OF THE DISCLOSURE

Described herein are quick-connected twisted pair cable system. These systems are configured to allow quick connection between the twisted pair cable and a quick plug connector to form a twisted-pair cable with a connector (e.g., plug) that may be used to connect electronic equipment. These connectors may be attached without the need for separate cutting, stripping and coupling steps and/or equipment.

In particular, the apparatuses (e.g., devices, systems, cables, connectors, etc.) described herein may include quick-connect twisted pair cable that extends in an elongate length (e.g., 1 meter or more, 2 meters or more, 3 meters or more, 4 meters or more, 5 meters or more, 6 meters or more, 7 meters or more, 8 meters or more, etc.). The quick-connect twisted pair cable typically includes tubular regions that are separated at intervals by flattened regions to which the connector may be connected, cutting the quick-connect twisted pair cable and attaching the connector at this flattened region, as will be described.

For example, a quick-connect twisted pair cable may include: a plurality of pairs of insulated wires; and an outer insulating cover forming an elongate body having a plurality of flattened regions alternating between tubular body regions, wherein the tubular body regions have lengths that are greater than 5 times the length of the flattened regions; wherein the pair of wires of each of the plurality of pairs of insulated wires are wrapped around each other within the tubular body regions and not wrapped around each other in the flattened regions.

The insulated wires may generally include a conductive core (e.g., metal, polymer, etc.) surrounded by an insulating outer cover. The insulating outer cover may be a dielectric material. The insulating outer cover may be sprayed onto the conductive wire, or otherwise attached. The pairs of insulating wires may be matched, as is known in other twisted pair cables, e.g., carrying input/output.

The outer insulating cover may be formed of a material that is compliant. The insulating outer cover may be electrically insulating and may be hollow, providing one or more passages for the pairs of insulated wires. The tubular body regions may be configured to be generally tubular (e.g., having a generally oval or rounded cross-section); the flattened regions may have a generally rectangular cross-section. In general, the diameter (e.g., average diameter) transvers to the long axis of the cable of tubular region is greater than the diameter of the flattened region (e.g., the diameter of the tubular region may be greater than 40%, 50%, 60%, 70%, 80%, 90%, 100%, 120%, 130%, etc. of the diameter of the flattened region).

The tubular body regions may have a length (e.g., average length, or minimum length) of greater than 30 cm. In some variations, the tubular body regions have a minimum length of 1 meter. In some variations, the tubular body regions have a length of between 0.5 meters and 3 meters. Thus, the flattened regions may be separated from each other by a regular or irregular distance. For example, the length of the tubular body regions may vary.

Any appropriate number of pairs of insulated (twisted) wires may be used. For example, the plurality of pairs of insulated wires may comprise 4 or more pairs.

Any length of cable may be configured as described herein. In some variations, the outer insulating cover extend for greater than 3 meters (e.g., 5 meters or more, 7 meters or more, 10 meter or more, 15 meters or more 20 meters or more, 30 meters or more 50 meters or more, 100 meters or more, etc.).

In general, the length of each flattened region is much less than the length of the tubular region(s). For example, the length of the flattened regions may be less than 25% the length of the tubular region, less than 20% the length of the tubular region, less than 15% the length of the tubular region, less than 10% the length of the tubular region, less than 7% the length of the tubular region, less than 5% the length of the tubular region, less than 4% the length of the tubular region, less than 3% the length of the tubular region, less than 2% the length of the tubular region, etc. For example, the flattened regions may have an average length that is 5 cm or less (e.g., 4 cm or less, 3 cm or less, 2 cm or less, etc.). Alternatively or additionally, the tubular body regions may have lengths that are, on average, greater than 10 times the length of the flattened regions.

Any of the quick-connect twisted pair cables described herein may include a projecting guide or alignment region extending from the outer insulating region, and particularly the flattened region. For example, the flattened region may have a guide projection extending from one side. The guide portion may be a keying projection that aligns with a channel or key in the connector, or it may be configured as a stop that limits movement of the connector when attaching/coupling to the flattened region.

The quick connect twisted pair cable of claim 1, wherein the pair of wires of each of the plurality of pairs of insulated wires within the tubular body are wrapped around each other with a pitch of at least 10 turns per meter.

Also described herein are systems for quick-connecting a twisted pair cable. Any of these systems may include a quick-connect twisted pair cable, which may be of any of the variations described above, and a quick plug connector. For example, a system may include: a quick-connect twisted pair cable comprising: a plurality of pairs of insulated wires; an outer insulating cover forming an elongate body having a plurality of flattened regions alternating between tubular body regions, wherein the tubular body regions have lengths that are greater than 5 times the length of the flattened regions; wherein the pair of wires of each of the plurality of pairs of insulated wires are wrapped around each other within the tubular body regions and not wrapped around each other in the flattened regions; and a quick plug connector configured to clip onto one of the flattened regions, the quick plug connector having a cutter for cutting the quick-connect twisted pair cable, and a plurality of prongs, wherein each prong is configured to be placed in electrical contact with one of the insulated wires from the plurality of pairs of insulated wires.

Any of these systems may include a lock on the quick plug connector configured to lock the quick plug connector onto the quick-connect twisted pair cable after cutting it. The quick plug connector may have a cutter (e.g., blade, cutting element, etc.) that cuts though the flattened region, including the wires and the outer cover) and/or a plurality of pins or prongs or other electrical elements that make electrical contact between the pins of the connector and the insulated wires. In some variations the quick plug connector includes a stripping element to strip the insulation from a portion of the wires.

Any of the quick plug connectors described herein may be configured as know connectors (standard connectors), such as RJ-45 connectors.

Also described herein are methods of connecting, forming and/or operating any of the apparatuses described herein. For example, described herein are methods of connecting a quick plug connector to a quick-connect twisted pair cable, the method comprising: closing the quick plug connector over a target flattened region of a quick-connect twisted pair cable, wherein the quick-connect twisted pair cable comprises: a plurality of pairs of insulated wires, an outer insulating cover forming an elongate body having a plurality of flattened regions, including the target flattened region, alternating between tubular body regions, wherein the tubular body regions have lengths that are greater than 5 times the lengths of the plurality of flattened regions, further wherein the pair of wires of each of the plurality of pairs of insulated wires are wrapped around each other within the tubular body regions and not wrapped around each other in the flattened regions; cutting, with the quick plug connector, the target flattened region of a quick-connect twisted pair cable; and making electrical contact between the plurality of pairs of insulated wires in the target flattened region and a plurality of prongs on the quick plug connector. The method may include locking the quick plug connector onto the flattened region of the quick-connect twisted pair cable.

In general, any of these methods may include removing the portion of the quick-connect twisted pair cable not attached locked onto the quick plug connector, e.g., after cutting the cable at the flattened region.

Any of these methods may include stripping, with the quick plug connector, an insulator from each of the insulated wires of the plurality of pairs of insulated wires.

Any of these methods may include placing the quick-connect twisted pair cable into the quick plug connector, e.g., before closing the connector. Closing may comprise moving a hinged jaw over the quick-connect twisted pair cable at the target flattened region.

Cutting the target flattened region may occur when the quick plug connector is closed over the quick-connect twisted pair cable.

Making electrical contact may comprise driving a plurality of pins in the quick plug connector into the target flattened region, wherein each pin is in electrical contact with a prong of the quick plug connector.

Also described herein are quick connected Ethernet cable systems. These systems are configured to allow quick connection between the twisted pair cable segments to obtain an Ethernet cable with the desirable length that may be used to connect electronic equipment. These cables may be attached without the need for separate cutting, and stripping steps and/or equipment, and or special assembly. The special termination end on the cable segment allows Ethernet cable to route through small holes in wall with ease.

In one aspect, the disclosure provides a quick connect Ethernet cable segment having a predetermined length and a diameter. The cable segment includes a quick plug attached to a first end of a plurality of pairs of insulated wires and configured to adapt to a standard Ethernet port; a connector attached to a second end of the plurality of pairs of insulated wires, said connector having a cross-section comprising a plurality of slots, wherein the cross-section has a cross-sectional length, which is less than the predetermined length of the cable segment and about the same as the diameter of the cable segment; an outer insulation layer wrapped around the connector to shield the connector from interference; and wherein the connector is configured for coupling with a second Ethernet cable segment to extend the Ethernet cable.

In another aspect, the disclosure provides an Ethernet cable to both provide power and transmit optical signals between devices. The cable includes a quick connect Ethernet cable segment having a predetermined length and a diameter comprising: a quick plug attached to a first end of a plurality of pairs of insulated wires and configured to adapt to a standard Ethernet port; a connector attached to a second end of the plurality of pairs of insulated wires, said connector having a cross-section comprising a plurality of slots, wherein the cross-section has a cross-sectional length, which is less than the predetermined length of the cable and about the same as the diameter of the quick connect Ethernet cable segment; a second cable segment comprising an adaptor attached to a first end of a plurality of pairs of insulated wires and a quick plug attached to a second end of the plurality of wires and configured to adapt to a second standard Ethernet port, wherein the adaptor comprises a plurality of protrusion members engaged with the plurality of slots.

In yet another aspect, the disclosure provides a method for forming an Ethernet cable having a predetermined length and a diameter to both provide power and transmit optical signals between devices. The method includes providing a first Ethernet cable segment comprising quick plug attached to a first end of the first Ethernet cable segment and a connector attached to a second end of the first Ethernet cable segment; and joining the connector with an adaptor attached to a first end of a second Ethernet cable segment to form the Ethernet cable with the predetermined length, wherein the connector has a cross-section comprising a plurality of slots, wherein the cross-section has a cross-sectional length, which is less than the length of the first Ethernet cable segment and about the same as the diameter of the first Ethernet cable segment.

In general, any of the cables and cable systems described herein may be used with any element or component of each of these various cables and cable systems described herein.

BRIEF DESCRIPTION OF THE DRAWINGS

The novel features of the invention are set forth with particularity in the claims that follow. A better understanding of the features and advantages of the present invention will be obtained by reference to the following detailed description that sets forth illustrative embodiments, in which the principles of the invention are utilized, and the accompanying drawings of which:

FIG. 1A shows a twisted pair cable including a plurality (e.g., four pairs) of twisted pairs that are collected together in a cable sheath. FIG. 1B shows a connector (e.g., an RJ-45 plug connector) that may be connected to the twisted pair cable wires. FIG. 1C shows a method of manually assembling and coupling the wires of the twisted pair cable to the connector.

In FIG. 4A, an elongate length of cable is shown. FIG. 4B shows a top view of an exemplary flattened, untwisted region. FIG. 4C shows a side view of the same region of FIG. 4B.

In FIG. 5A, an elongate length of cable is shown. FIG. 5B shows a top view of an exemplary flattened, untwisted region. FIG. 5C shows a side view of the same region of FIG. 5B. FIG. 5D is a sectional view through the twisted cable region indicated (region "D") in FIG. 5B. FIG. 5E is a sectional view through the flattened, untwisted cable region (region "E") in FIG. 5B.

In FIG. 7A, the quick connect twisted pair cable is placed into an opening in the quick connect connector. The quick connector may couple into the cable, cut it and make an electrical connection between each of the untwisted wires and the one or more pins (contacts) on the connector.

DETAILED DESCRIPTION

In general, descried herein are method and apparatuses (e.g., devices, systems, etc., including cabling adapted to allow easy coupling and formation of a connector at or along a length of the cable.

Figure 1A:
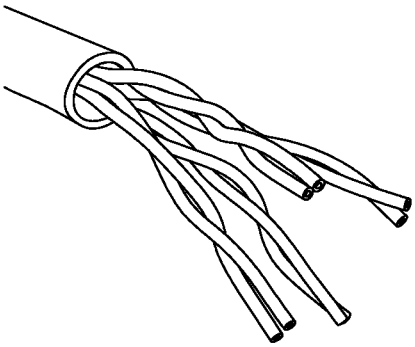
FIGS. 1A-1C illustrate forming a connector for a prior art twisted pair cable.
Figure 1B:
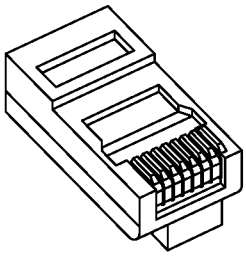
Figure 1C:
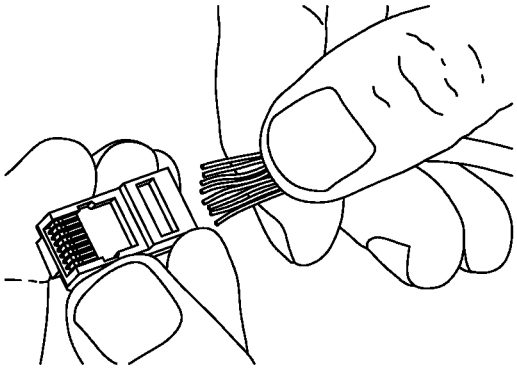

Prior to the methods and apparatuses described herein, forming a connection in a twisted pair cabling required multiple steps and a variety of tools operating on the twisted pair cabling. An example of this is illustrated in FIGS. 1A-1C and 2A-2I. For example, FIG. A shows the end of an elongate length of twisted cabling that has been cut to a user-selected length; this length may be arbitrary. The existing twisted pair cabling includes a plurality of pairs (e.g., four pairs) of twisted pair cables; in FIG. 1A, four pairs are shown. These pairs are matched as desired. FIG. 1B shows an exemplary connector (e.g., RJ-45) that may be coupled to the twisted pair cabling. FIG. 1C, illustrates assembly of a connector onto a twisted pair.

Figure 2A:
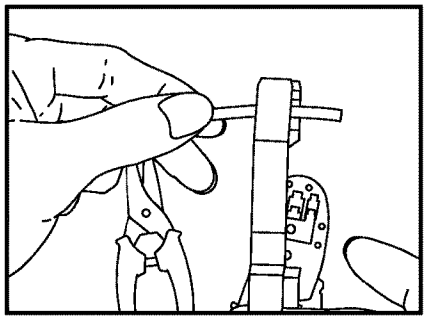
FIGS. 2A-2I illustrate a typical prior-art method forming a connector (e.g., plug) on a length of twisted-pair cabling.
Figure 2B:
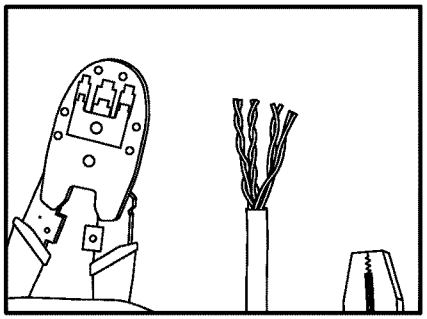

FIGS. 2A-2I illustrate a prior art method of connecting a connector (e.g., an RJ-45) connector to a twisted pair cabling. Typically, a crimping tool is required to crimp or connect a connector to the end of a cable. For example, twisted pair network cables and/or phone cables may be created using a crimping tool to connect a connector such as an RJ-45 or RJ-11 connector to an end of the cable. One the length of twisted pair cabling is selected, it must first be cut and stripped. For example, a twisted pair cable may be stripped, using a wire stripper, of the plastic sheath from approximately 2-3 cm (FIG. 2A) of the cut ends of the twisted pairs of wires within the twisted pair cabling. As shown in FIG. 2B, the paired wires must then be untwisted, to separate them, and arranged in the appropriate order, which may be indicated by the (e.g., colored and/or patterned) markings on the wires.

Figure 2C:
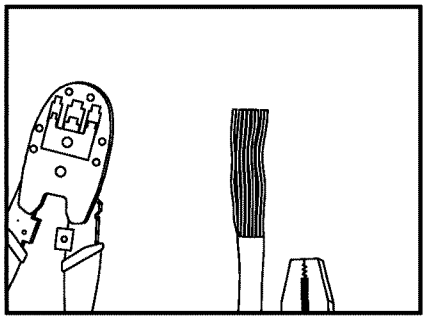
Figure 2D:
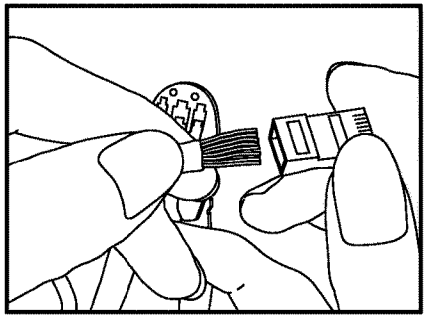
Figure 2E:
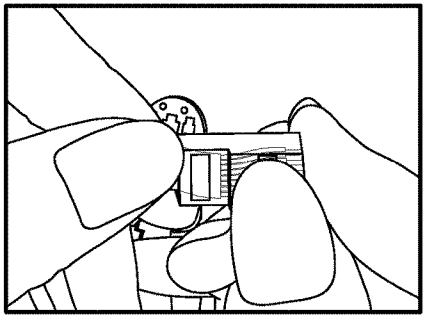
Figure 2F:
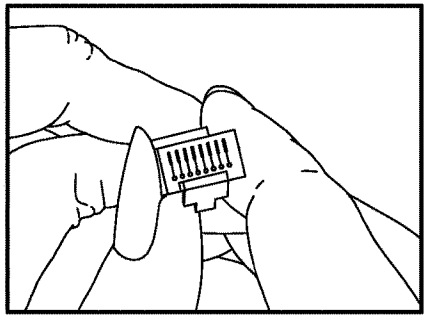
Figure 2G:
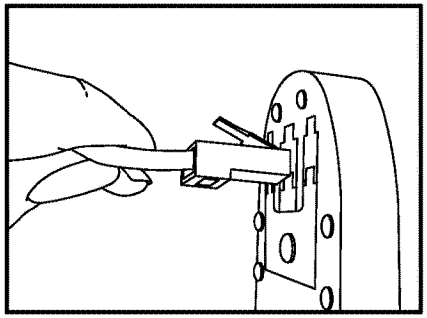
Figure 2H:
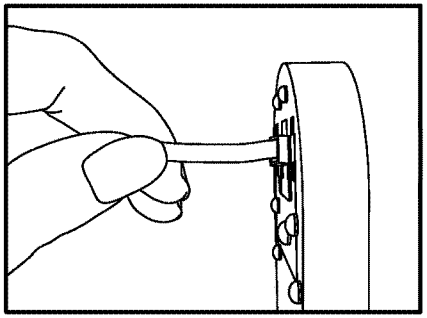
Figure 2I:
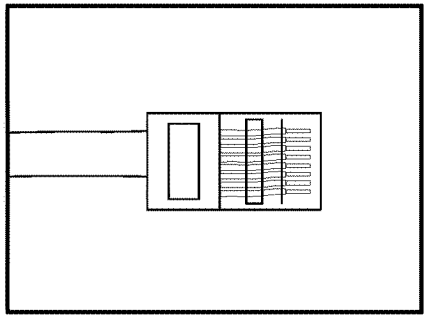

As shown in FIG. 2C, the wires may then be peeled and arranged in the appropriate order, in a line that will correspond to the core standard order (e.g., T568B standard). The bare twisted-pair core may then be trimmed, e.g., using a pair of pressure pliers, wire cutter, diagonal pliers or other appropriate tool, leaving about 13 mm in length, as shown in FIG. 2D. Thereafter, the wires may be inserted into the connector, as shown in FIG. 2E. For example, the head of the connector may be pinched (e.g., with the thumb and middle finger), while the other hand may pinch the twisted pair cabling, and may force the ends of the stripped wires (e.g., the eight twisted pair wires) into the connector head slowly. The connection may then be checked (FIG. 2F). For example, the apparatus may be checked to be sure that the wires have been properly inserted into the connector head in the correct/desired line sequence. Once confirmed, the wires may be crimped as shown in FIG. 2G; in this example, the RJ45 Plug is pushed into the pressure line clamp slot clenched by crimping pliers. Using the same general method shown in FIGS. 2A-2G, the other side of the twisted pair may be processed to add a connector (e.g., for direct access) to the network cable.

In general, the quick-connect twisted pair cables described herein may include a plurality of pairs of insulated wires within an elongate (e.g., insulated) body. The elongate body is formed to have alternating region of tubular regions and flattened regions, within which a plurality of pair of insulated wires extend; the wires in each pair are twisted around each other in the tubular regions and untwisted (e.g., parallel in a plane) in the flattened regions. The elongate body is formed, at least in part, by an outer insulating cover. A connector (e.g., a quick plug connector) may be attached at one of the flattened regions, cutting the cable at this connection and making electrical connection with the connector pins. The connector and cable together are configured so that the connector may be attached without requiring additional cutting, stripping and connecting steps. The spacing between the flattened regions may be between, e.g., 20 cm and 5 meters (e.g., between 30 cm and 5 meters, etc., less than 2 meters, less than 1.5 meters, less than 1.1 meters, less than 1 meter, less than 90 cm, less than 80 cm, less than 70 cm, less than 60 cm, less than 50 cm, etc.). The tubular body regions may have lengths that are greater than 5 times the length of the flattened regions.

Figure 3A:
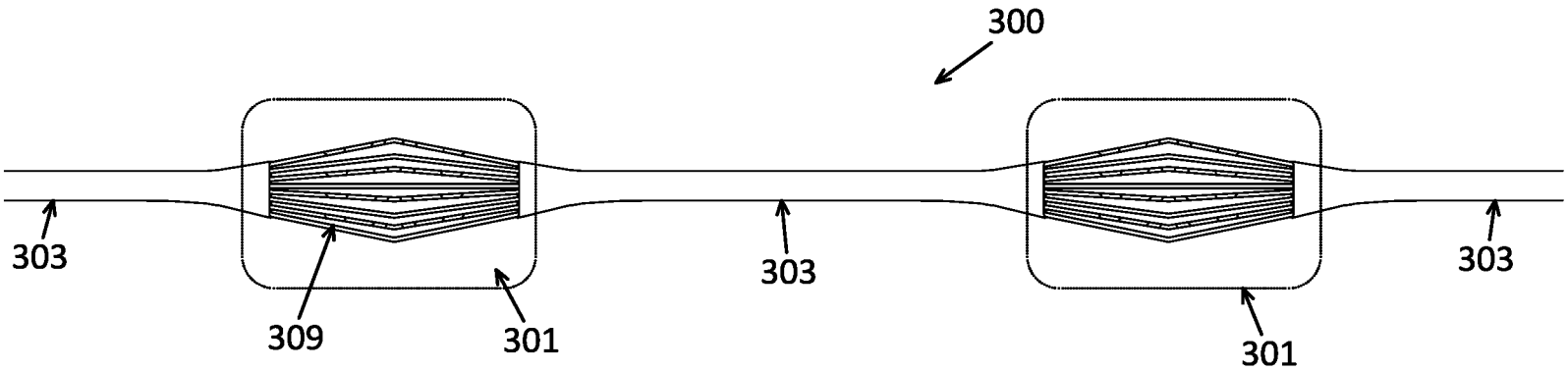
FIG. 3A illustrates a first example of a quick connect twist pair cable as described herein, showing exposed untwisted regions separated by lengths of twisted regions (in which the twisted pairs are twisted and gathered together within a cable housing. The untwisted regions are flattened.

For example, FIG. 3A illustrates one example of a quick-connect twisted pair cable showing tubular regions 303 alternating with quick-connect regions, flattened regions 301. The pairs of insulated wires in the tubular region are twisted (not shown), and may be arranged similar or identically to other twisted-pair cables. In some variations the twisted-pair cables may be configured so they are twisted with a pitch of between 5 turns/meter and 100 turns/meter within the tubular region(s). In the flattened regions, the insulated wires 309 are arranged in in a plane, adjacent to each other, as shown in FIG. 3A. In FIG. 3A, the flattened regions are shown with the insulating outer cover removed. This region may be removed, or it may be included. In this example, the flattened regions have a roughly diamond shape.

In FIG. 3A, the untwisted regions (the flattened regions) may be at regular intervals, such as every meter (e.g., every 0.3 meters, 0.4 meters, 0.5 meters, 0.6 meters, 0.7 meters, 0.8 meters, 0.9 meters, 1 meter, 1.1 meters, etc., including between ever 0.2 meters and ever 5 meters, e.g., ever 0.3 meters and ever 2 meters, etc.).

Figure 3B:
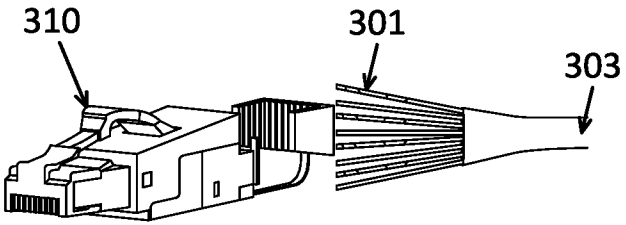
FIG. 3B shows an example of a connector (quick connector or quick plug connector) for use with a quick connect twist pair cable similar to that shown in FIG. 3A.

In FIG. 3B, the system including both the quick-connect twisted pair cable of FIG. 3A and a quick plug connector 310 are shown. In this example, the quick plug connector may be attached over the flattened ('quick connect') regions to both cut the cable and secure the connector to the cable in electrical contact with all of the insulated wires.

Figure 4A:
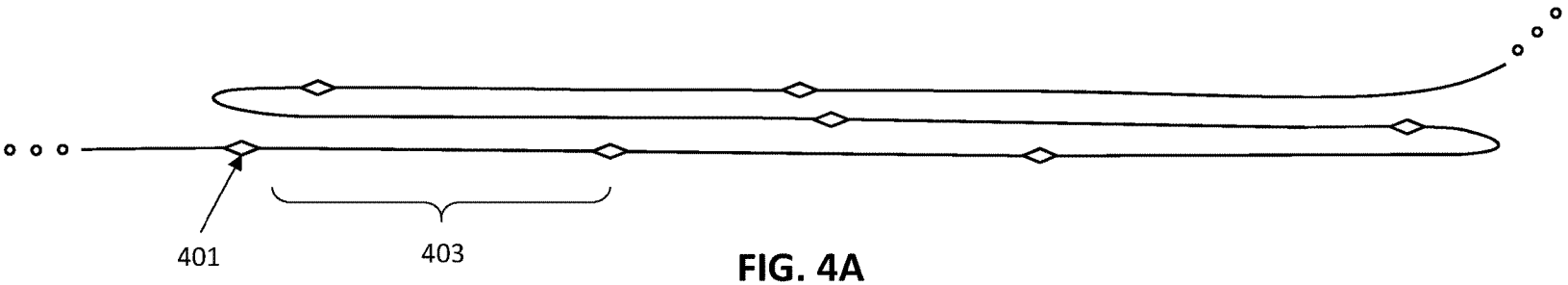
FIGS. 4A-4C illustrate another example of a quick connect twisted pair cable having an elongate length in which a plurality of pairs of wires are twisted together within the tubular section, along with 'untwisted' regions in which the cable is flattened; these flattened, untwisted regions are formed periodically along the length for short spans. A quick connector as described herein may be used to form a connection at these regions.

FIGS. 4A-6B illustrate variations of the quick-connect twisted pair cables described herein. For example, FIG. 4A, shows an example, of a quick-connect twisted pair cable length 400 having a plurality of flattened regions 401 that are separated by elongate tubular lengths 403. These lengths may be separated by regular or irregular lengths. FIG. 4B shows a close up of one of the flattened, quick-connect, regions 401 in a top view. The flattened region has a larger width than tubular region, to provide space for the insulated wires (within the outer cover, not visible in FIGS. 4A-4B) to be untwisted and adjacent to each other. FIG. 4C shows a side view of the flattened region, showing that height of the flattened region (e.g., the diameter transverse to the long axis) is much thinner when compared to the tubular region.

Figure 4B:
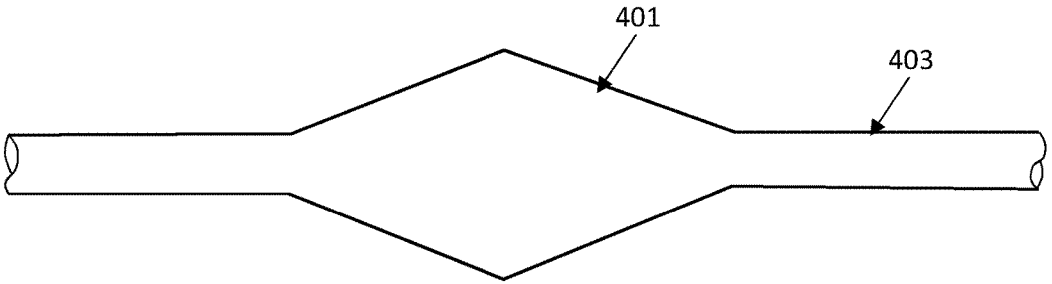
Figure 4C:
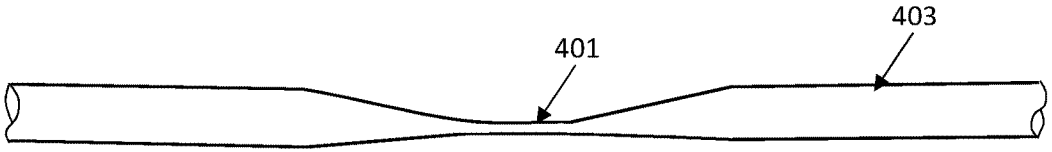
Figure 5A:
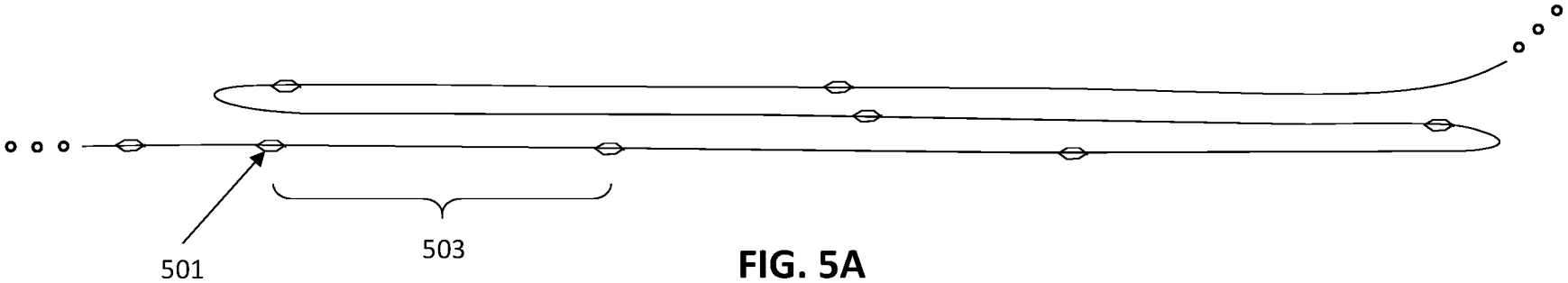
FIG. 5A-5E illustrate another example of a quick connect twisted pair cable having an elongate length in which a plurality of pairs of wires are twisted together within the tubular section, along with 'untwisted' regions in which the cable is flattened; these flattened, untwisted regions are formed periodically along the length for short spans. A quick connector as described herein may be used to form a connection at these regions.
Figure 5B:
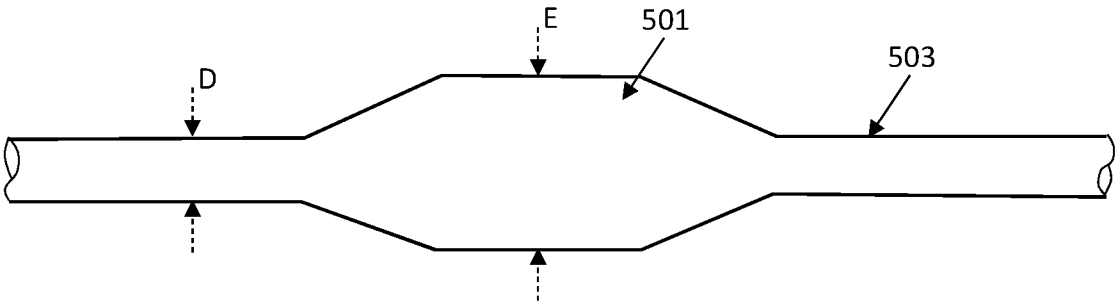
Figure 5C:
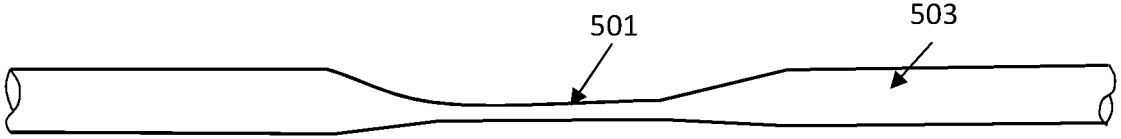

FIGS. 5A-5C shows a similar quick-connect twisted pair cable to that shown in FIG. 4A-4C, however the flattened region is roughly hexagonal or oval shaped. In this example, the flattened region 501 includes a central stretch along which the insulated wires are arranged in parallel, in the same plane. The flattened region 501 may be longer than that shown in FIG. 4A-4C, however it is still much shorter than the tubular regions 503 on either side of the flattened region.

Figure 5E:
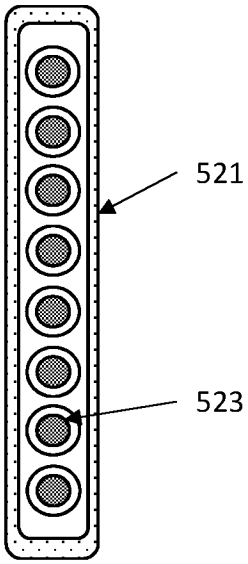
Figure 5D:
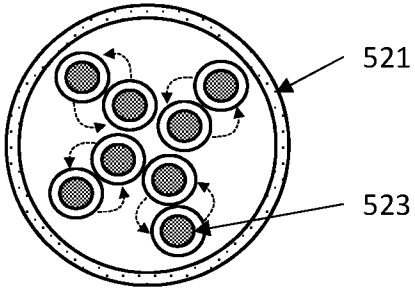

As mentioned, the thickness (e.g., the height perpendicular to the long axis of the cable) of the tubular region is typically larger than the thickness of the flattened region, as shown in FIG. 5C. FIG. 5D shows a section through FIG. 5B at D, and illustrates the thickness of the quick-connect twisted pair cable through the tubular region. As shown in FIG. 5D, the outer insulating cover 521 is roughly circular (other cross-sectional shapes, e.g., oval, rectangular, hexagonal, heptagonal, octagonal, etc. may be used). In FIG. 5D four pairs of cables are shown, arranged as twisted-pair cables. This region may be formed by twisting each of the insulated wires 523 in the pairs around each other along the length of the non-flattened body of the insulating cover. In FIG. 5D the arrows indicate the rotation of the pairs of insulated wires around each other (shown as anti-clockwise in FIG. 5D). In contrast, FIG. 5E illustrates a similar view of a section through the flattened region showing the section including all eight insulated wires 523 arranged in the plane of the flattened region surrounded by the outer cover 521.

Figure 6A:
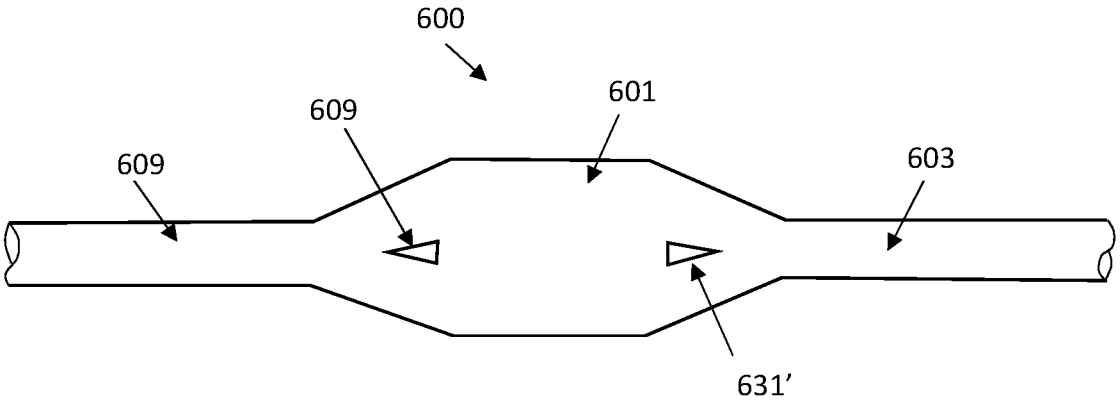
FIGS. 6A and 6B show top and side views, respectively, of an example of another variation of a quick connect twisted pair cable, similar to that shown in FIGS. 5A-5E but with an outer registration marker or protrusion that may be use to assist the connector in coupling with, cutting and forming the connection (quick connection) as described herein.
Figure 6B:
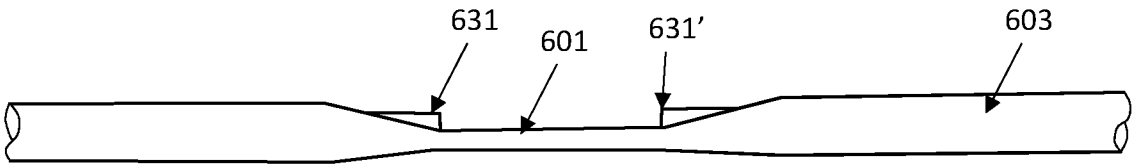

FIGS. 6A-6B show another example of a quick-connect twisted pair cable 600, similar to that shown in FIGS. 5A-5C, in which the outer cover 609 includes a pair (though one or more may be used) alignment protrusions 631, 631' in the flattened region 601 and/or adjacent tubular region 603. The alignment protrusions may be used by a connector (e.g., a quick plug connector) to help guide and hold the quick plug connector on the cable.

Figures 7A, 7B:
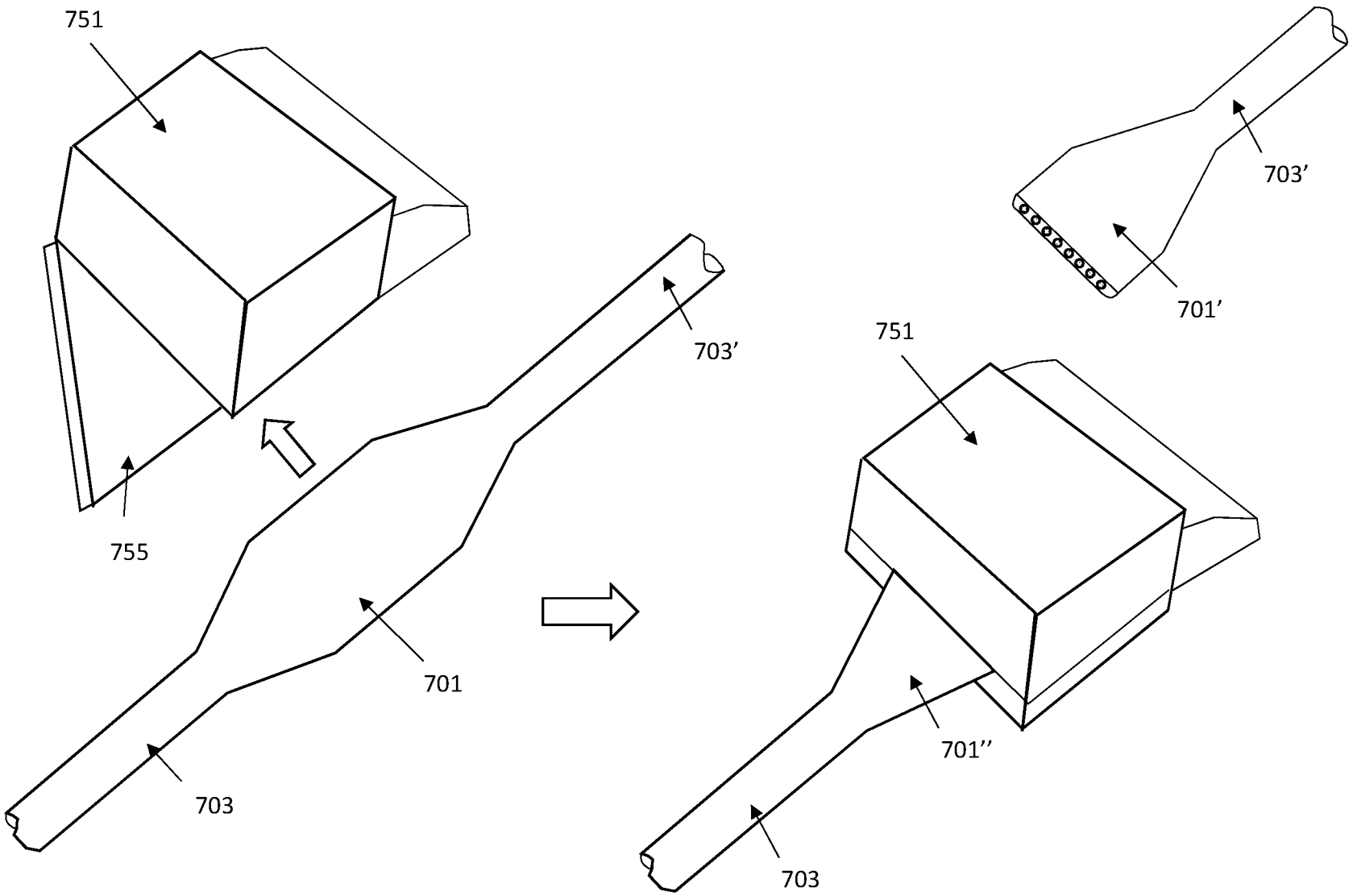
FIG. 7A is an example illustrating forming a connection using a quick connector (quick plug connector) and a quick connect twisted pair cable as described herein.
In FIG. 7B the assembled quick connector (closed and locked over and onto the quick conn twisted pair cable) is shown.

FIGS. 7A-7B illustrate attachment of a quick plug connector to a cable. Cutting, stripping and connecting may be performed in a single step, as shown in FIGS. 7A-7B. In this example, the connector 751 may include a separate or separable movable jaw (e.g., a hinged jaw), and, as shown in FIG. 7A, the flattened region 701 of the cable may be placed into the quick plug connector open jaw 755. Once the connector is over the flattened region of the cable, it may be closed against it. In some variations, in the process of closing the jaw it may cut through the cable, and/or may pierce the flattened region of the cable where the positions of the insulated wires is known with a high degree of confidence. The insulated wires may be penetrated and/or they may be stripped so that robust electrical connection can be made with pins, prongs, etc. in the connector.

In FIG. 7B, the connector 751 has been closed over the proximal dies of the cable. The distal end of the cable 703' (distal to the flattened region 701') may be removed or may fall away upon cutting/closing the quick plug connector 751. The quick plug connector may then be locked onto the cut end of the cable 703 at the flattened region 701" that has been cut to remove the unwanted length 703'.

Any of the methods (including user interfaces) described herein may be implemented as software, hardware or firmware, and may be described as a non-transitory computer-readable storage medium storing a set of instructions capable of being executed by a processor (e.g., computer, tablet, smartphone, etc.), that when executed by the processor causes the processor to control perform any of the steps, including but not limited to: displaying, communicating with the user, analyzing, modifying parameters (including timing, frequency, intensity, etc.), determining, alerting, or the like.

ADDITIONAL EXAMPLES

In general, also descried herein are method and quick connect cable segments and adaptors to allow easy coupling and formation of an Ethernet cable with a desirable length. The pre-made Ethernet cable segment (which may include any of the cables described above) may have a special termination end, which has the advantage of routing through small holes in walls.

Prior to the methods and quick connect cables described herein, forming a connection in a twisted pair cabling required multiple steps and a variety of tools operating on the twisted pair cabling.

Figure 8:
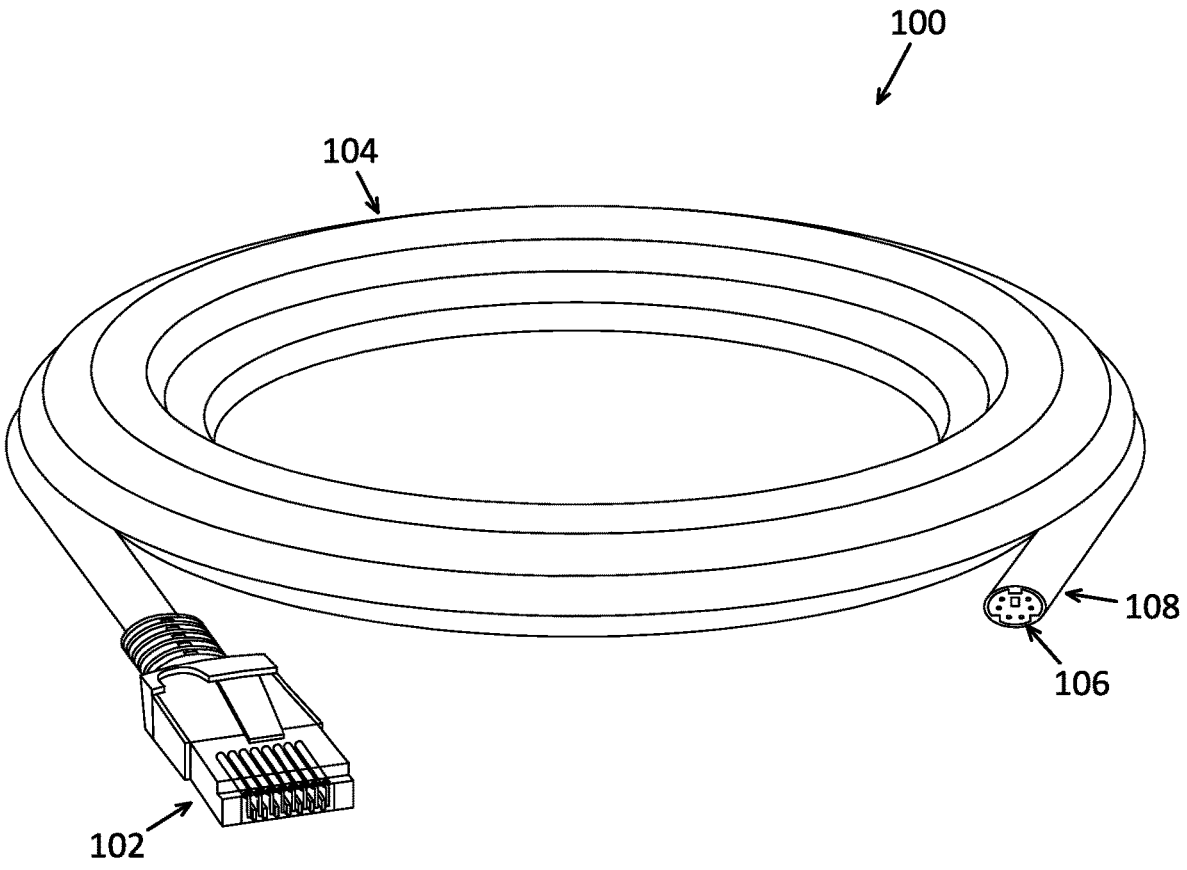
FIG. 8 illustrates a pre-made Ethernet cable segment with a predetermined length for quick connecting to another Ethernet cable segment.

FIG. 8 illustrates an example of a quick connect Ethernet cable segment having a pre-assembled end (with a connector) and an end that is terminated with a small (quick connect) jack. The cable segment may have a predetermined length (e.g., 0.5 meters, 1 meter, 2 meters, 3 meters, 4 meters, 5 meters, 10 meters, 15 meters, 20 meters, 25 meters, 30 meters, etc.). The connector on the pre-assembled end may be a standard jack type, such as an RJ45, RJ45s or 8P8C connectors. In FIG. 8, the standard connector is an RJ45 connector 102 attached to the first end of a plurality of pairs of insulated wires (not visible with the length of cable 104). The connector 106 on the opposite end of the length of cable is configured to easily mate with a connector (shown in FIG. 9) to make reliable connection with the plurality of pairs of insulated wires. The connector 106 may be configured to be very low profile, so that the maximum diameter of this connection is the same as or less than the maximum diameter of the length of cable proximal to it. This may allow it to be passed through walls and/or conduit or other regions that have a very small diameter.

In any of these variations, the connector 106 may be shielded (RF shielded) even despite the narrow diameter. For example, the quick connector may have an outer insulation layer 108 wrapped around the connector to shield the connector from interference. As shown in FIG. 8, the cross-section of the connector 106 may include a plurality of slots or openings. The face of the connector may be flush or recessed into the outer sheath (which may include shielding). As mentioned, the cross-sectional diameter (the maximum diameter of the cross-section) in this example is less than the region of the length of the cable immediately proximal to it. The diameter of the cross-section may be about the same as the diameter of the cable segment. The connector can be configured to couple with a second Ethernet cable segment.

The quick connector 106 on the distal end of the length of cable may be keyed (e.g., with one or more slots) for connection in a particular orientation. Alternatively in some variations the connector is not keyed, but is configured to be attached in a variety of orientations. In some variation, it may be connected quickly and easily in any orientation and the mapping of which of the pairs of wires (twisted wires) connect to which of the end of the wire(s) at the opposite end of the connected cable may be determined at one end of the cable by additional circuitry, including one or more switches (not shown).

In some variations, the slots or openings on the cable at the quick connector are arranged in a circle, grid, loop or spiral pattern. In FIG. 8, the pattern is a circle. Some patterns may be preferred, including concentric (e.g., target/bullseye patterns, spiral patterns, etc.) as they may enhance shielding and/or quick connection.

As mentioned, the standard connector 102 on the opposite end of the cable may be configured adaptable to a standard Ethernet port or socket. The quick plug can be a modular connector such as a registered jack. Non-limiting exemplary modular connectors include RJ connectors, such as RJ45, RJ9, RJ11 and RJ22 connectors. Other modular connectors may be used include RJ49, RJ61, RJ14 and RJ25. In some embodiments, the quick plug is an RJ-45 connector.

The cable segment can have various length, for example, from about 1 cm to over 500 m. In some instances, the first cable segment can be from about 0.5 m to about 5 m, from about 0.5 m to about 10 m, from about 0.5 m to about 20 m, from about 0.5 m to about 30 m, from about 1 m to about 20 m, from about 5 m to about 10 m, from about 5 m to about 20 m, or from about 5 m to about 30 m. Depending on the specific applications, the cable segment can be about 0.01 m, about 0.05 m, about 0.1 m, about 0.5 m, about 1 m, about 2 m, about 3 m, about 4 m, about 5 m, about 6 m, about 7 m, about 8 m, about 9 m, about 10 m, about 11 m, about 12 m, about 13 m, about 14 m, about 15 m, about 16 m, about 17 m, about 18 m, about 19 m, about 20 m, about 22 m, about 25 m, about 28 m, about 30 m or about 50 m.

The connector can be a small diameter jack. The cross-section of the connector can have various shapes, such as circle, oval, square, rhombus, parallelogram, trapezoid, kite, pentagon, hexagon, heptagon, octagon, nonagon, decagon, irregular pentagon, irregular hexagon, irregular heptagon, irregular octagon, irregular nonagon, irregular decagon or a combination thereof. In one embodiment, the connector has a modified circular shape.

The cross-section of the connector has a plurality of slots. The slots can have a rectangular, a circular or an oval shape. The distance between the two adjacent slots can be the same or different on the cross-section. In some embodiments, the cross-section has 2, 3, 4, 5, 6, 7 or 8 slots for coupling with an adaptor of another Ethernet cable segment. The slots can have the same dimension or different sizes. In one embodiment, the cross-section has seven slots, wherein six of the seven slots have the same size and one of the seven slots has a different size.

The length of the cross-section of the connector is less than the predetermined length of the cable segment. The length of the cross-section is about the same as the diameter of the cable segment. The cable segment can have various diameter or ross-section length. For example, the diameter of the cable segment or the length of the cross-section of the connector is at least about 1 mm, 2 mm, or 3 mm. In some instances, the diameter of the cable segment or the length of the cross-section of the connector can be less than about 10 mm, about 9 mm, about 8 mm, about 7 mm, about 6 mm, about 5 mm, about 4 mm, or about 3 mm. In some embodiments, the diameter of the cable segment or the length of the cross-section of the connector is about 3 mm, about 4 mm, about 5 mm, about 6 mm, about 7 mm, about 8 mm, about 9 mm or about 10 mm. In other embodiments, the diameter of the cable segment or the length of the cross-section of the connector is about 1.0 cm, about 1.1 cm, about 1.2 cm, about 1.3 cm, about 1.4 cm, or about 1.5 cm.

The plurality of insulated wires can include 4 or more pairs of wires, for example, 4, 5, 6, 7, or 8 pairs of wires. Typically, the pairs of wires are twisted cable wires.

To shield the connector from the interference, such as electromagnetic interference, electromagnetic cross-talk, noise, spurious emissions, electrical noise, electronic interference, the connector has an outer insulation layer, which can be in direct contact with the connector or through an intermediate layer. The outer insulation layer is generally wrapped around the connector. Various interference materials can be used. For example, the insulation layer can be made of a metallic material or a mix of polymers and metallic materials.

Figure 9:
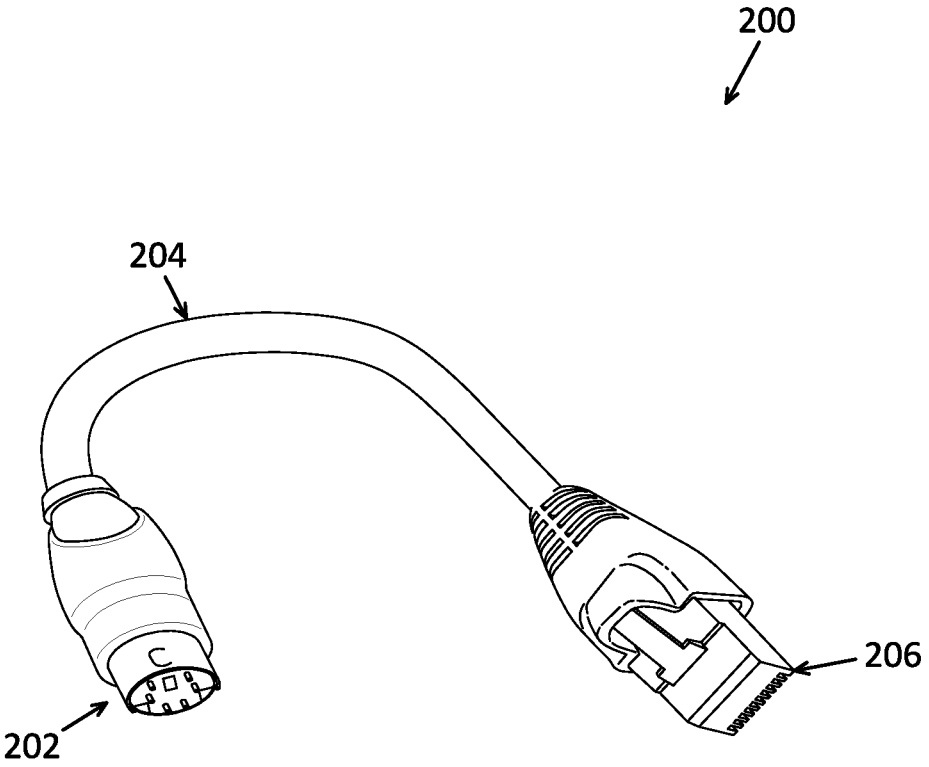
FIG. 9 illustrates an end adaptor used for quick connecting with a pre-made Ethernet cable segment to complete installation of an Ethernet cable.

FIG. 9 illustrates a second cable segment used for completing installation of an extended cable. The second Ethernet cable segment has an adaptor 202 attached to a plurality of pairs of insulated wires 204 each and a standard plug 206 (which may be any of the standard or custom Ethernet connectors described herein) attached to the second end of plurality of pairs of insulated wires, wherein the quick plug 206 is configured to adapt to a standard Ethernet port. Exemplary standard connector 206 is shown as an RJ-45 connector. The connector adaptor 202 in this example has a plurality of protrusion members such as pins and is configured to engage with the slots on the connector of the first Ethernet cable segment.

In some variations, an intermediate cable may be used to extend cable which includes a connector complimentary to the connector on the first length of cable, e.g., shown in FIG. 8. The quick (complementary) connector may include pins (contacts) that engage with the openings/slots on the quick connector 106 shown in FIG. 8. In some variations, the connectors may include a central locking region within the cable that secures two lengths of cables together, as well as electrical (e.g., RF) shielding around the outer sleeve. The central connector may be mechanical and/or electromagnetic. For example, a locking connector may extend from the length having the complementary connector and may mate with an opening (e.g., a central opening) in the first length of cable (similar to the length of cable 104 shown in FIG. 9). The locking connector may be keyed so that it allows connection in a preferred orientation. In some variations the locking connector may be releasable. In some variations the locking connector may not be releasable. The locking connector may alternatively be referred to as a central connector and it may not be locking. In some variations the central and/or locking connector may be magnetic, and may magnetically secure the two together. The magnet may be a static magnet (e.g., rare earth element magnet).

The intermediate cable may be any appropriate length, as discussed above, and the distal end of the cable may be a standard connector or, preferably, it may be another quick connect connector having a narrow diameter, similar to those discussed above (an example of which is shown in FIG. 8 as quick connector 106). In this way, multiple intermediate cables may be used to form longer lengths of cable; because the connector regions may be fully shielded and may be mechanically secured, and may have the same or slightly smaller maximum diameters, the cable may be used in even small/tight confines.

In some variations the maximum outer diameter (cross-sectional diameter) of an intermediate, complementary, connector may be the same or less than the maximum diameter of the rest of the cable (e.g., the region distal and/or proximal to the connectors). Alternatively, the connector may have a larger diameter, as shown in FIG. 9.

An Ethernet cable can be readily formed by connecting two (or more, e.g., using one more intermediate cables) cable segments together. Thus, provided herein is an Ethernet cables with a desirable variable (e.g., modular predetermined) lengths, which can provide power and transmit optical signals between devices. The Ethernet cable typically consists of a jack (e.g., a standard connector) at a first end and a quick connector at the opposite end; this may be mated to one or more additional length of cable via connection to the quick connector. In some variations the distal end may be terminated in a second cable extension (such as shown in FIG. 9) having a complimentary quick connector and an Ethernet jack (e.g., standard Ethernet connector). Additional, intermediate, lengths of cable having complimentary quick connectors may be used. As described herein, the first cable segment may have a predetermined length and a diameter, an Ethernet jack/plug attached to a first end, a narrow-diameter quick connector (with or in some cases without a central locking connector), and a plurality of pairs of insulated wires extending between the standard Ethernet jack and the quick connector. The narrow-diameter quick connector may be attached to a second end of the plurality of pairs of insulated wires, and may have a cross-section comprising a plurality of openings/slots (or for complementary quick connectors, pins or blades) extending proud thereof. The cross-sectional diameter may be the same as or less than the maximum diameter of the portion of the cable adjacent to the connector region (and the profile of the connector may match the profile of the catheter). As described herein, an additional, e.g., second, Ethernet cable segment may include a complementary (e.g., an adaptor) at one end of a length of cable having a plurality of pairs of insulated wires with either another quick (narrow-diameter) connector and/or a standard Ethernet jack at the opposite end. The complementary connector may include a plurality of protrusion members such as pins, blades, etc., that may engage with the plurality of slots of the narrow-diameter quick connector of the first cable segment. In one embodiment, the maximum diameter of the second Ethernet cable segment may be about the same or smaller than the maximum diameter of the first cable segment.

Also described herein are methods for forming an Ethernet cable from two or more lengths of the cables having one or more narrow-diameter quick connector(s) as described above. Generally, the method may include connecting two or more cable segments together to provide an Ethernet cable having a desirable length and standard Ethernet jacks (e.g., RJ45) at opposite ends of the cable. For example, the first Ethernet cable segment can have a standard Ethernet jack on one end and a narrow-diameter quick connector on the other end. The second Ethernet cable segment can have a narrow-diameter quick connector (configured as complementary to the narrow-diameter quick connector on the first cable) on one end and a standard Ethernet jack on the other end. The cable can be installed by joining the first narrow-diameter quick connector of the first cable segment with the complimentary narrow-diameter quick connect connector (e.g., narrow-diameter quick connect adaptor) of the second cable segment. Thus, provided herein is method of forming an Ethernet cable, which includes providing a first Ethernet cable segment comprising a standard Ethernet jack on a first end, a narrow-diameter quick connect on the second end of the cable segment, passing the narrow-diameter quick connector through a narrow diameter opening or channel, then mating the narrow-diameter quick connect connector with a second length of cable having a complementary connector (e.g., an adaptor) at one end and a standard Ethernet jack at the opposite end to form the Ethernet cable with the predetermined length. The narrow diameter quick connect connector may have a narrow cross-section and may include either a plurality of slots or openings and/or a plurality of protrusions/pins/blades configured extending therefrom, or some combination of these). The narrow-diameter quick connect connector may mate with a complimentary connector, which may be a narrow-diameter connector or an adapter such as shown in FIG. 9, comprising a plurality of complimentary openings, slots, pins, blades, etc.

In some embodiments, the connector of the quick connector (complimentary connector) for the second segment may have a diameter that is greater than, narrower or the same as the diameter of the first Ethernet cable segment. In certain instances, the diameter of end of the second Ethernet cable segment from the narrow-diameter quick connector to just before the standard Ethernet jack is about the same as the narrowest diameter of the first Ethernet cable segment. In FIG. 9 the example shown includes a quick connector (complementary quick connector 202) that is larger than the narrowest diameter of the first cable segment. The second Ethernet cable segment 204 can be made into various lengths to achieve the desired extension of the first Ethernet cable segment. For example, the second Ethernet cable is at least about 0.1 cm, about 0.2 cm, about 0.3 cm, about 0.4 cm or about 0.5 cm. In some situations, the second Ethernet cable is at least about 0.5 m.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Terminology used herein is for the purpose of describing particular embodiments only and is not intended to be limiting of the invention. For example, as used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be abbreviated as "/".

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

Although the terms "first" and "second" may be used herein to describe various features/elements (including steps), these features/elements should not be limited by these terms, unless the context indicates otherwise. These terms may be used to distinguish one feature/element from another feature/element. Thus, a first feature/element discussed below could be termed a second feature/element, and similarly, a second feature/element discussed below could be termed a first feature/element without departing from the teachings of the present invention.

Throughout this specification and the claims which follow, unless the context requires otherwise, the word "comprise", and variations such as "comprises" and "comprising" means various components can be co-jointly employed in the methods and articles (e.g., compositions and apparatuses including device and methods). For example, the term "comprising" will be understood to imply the inclusion of any stated elements or steps but not the exclusion of any other elements or steps.

In general, any of the apparatuses and methods described herein should be understood to be inclusive, but all or a sub-set of the components and/or steps may alternatively be exclusive, and may be expressed as "consisting of" or alternatively "consisting essentially of" the various components, steps, sub-components or sub-steps.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical values given herein should also be understood to include about or approximately that value, unless the context indicates otherwise. For example, if the value "10" is disclosed, then "about 10" is also disclosed. Any numerical range recited herein is intended to include all sub-ranges subsumed therein. It is also understood that when a value is disclosed that "less than or equal to" the value, "greater than or equal to the value" and possible ranges between values are also disclosed, as appropriately understood by the skilled artisan. For example, if the value "X" is disclosed the "less than or equal to X" as well as "greater than or equal to X" (e.g., where X is a numerical value) is also disclosed. It is also understood that the throughout the application, data is provided in a number of different formats, and that this data, represents endpoints and starting points, and ranges for any combination of the data points. For example, if a particular data point "10" and a particular data point "15" are disclosed, it is understood that greater than, greater than or equal to, less than, less than or equal to, and equal to 10 and 15 are considered disclosed as well as between 10 and 15. It is also understood that each unit between two particular units are also disclosed. For example, if 10 and 15 are disclosed, then 11, 12, 13, and 14 are also disclosed.

Although various illustrative embodiments are described above, any of a number of changes may be made to various embodiments without departing from the scope of the invention as described by the claims. For example, the order in which various described method steps are performed may often be changed in alternative embodiments, and in other alternative embodiments one or more method steps may be skipped altogether. Optional features of various device and system embodiments may be included in some embodiments and not in others. Therefore, the foregoing description is provided primarily for exemplary purposes and should not be interpreted to limit the scope of the invention as it is set forth in the claims.

The examples and illustrations included herein show, by way of illustration and not of limitation, specific embodiments in which the subject matter may be practiced. As mentioned, other embodiments may be utilized and derived there from, such that structural and logical substitutions and changes may be made without departing from the scope of this disclosure. Such embodiments of the inventive subject matter may be referred to herein individually or collectively by the term "invention" merely for convenience and without intending to voluntarily limit the scope of this application to any single invention or inventive concept, if more than one is, in fact, disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

What is claimed is:

1. A system for quick-connecting a twisted pair cable, the system comprising:

a quick-connect twisted pair cable comprising:

a plurality of pairs of insulated wires;

an outer insulating cover forming an elongate body having a plurality of flattened regions alternating between tubular body regions, wherein the tubular body regions have lengths that are greater than 5 times the length of the flattened regions;

wherein the pair of wires of each of the plurality of pairs of insulated wires are wrapped around each other within the tubular body regions and not wrapped around each other in the flattened regions; and a quick plug connector configured to:

cut and separate the quick-connect twisted pair cable into two separable cable segments at one of the flattened regions;

attach onto the flattened region of one of the cable segments; and electrically couple to one or more of the insulated wires from the plurality of pairs of insulated wires associated with the attached cable segment.

2. The system of claim 1, further comprising a lock on the quick plug connector configured to lock the quick plug connector onto the quick-connect twisted pair cable after cutting it.

3. The system of claim 1, wherein the quick plug connector is configured as an RJ-45 connector.

4. A method of connecting a quick plug connector to a quick-connect twisted pair cable, the method comprising:

closing the quick plug connector over a target flattened region of a quick-connect twisted pair cable, wherein the quick-connect twisted pair cable comprises:

a plurality of pairs of insulated wires; and an outer insulating cover forming an elongate body having a plurality of flattened regions, including the target flattened region, alternating between tubular body regions, wherein the tubular body regions have lengths that are greater than 5 times the lengths of the plurality of flattened regions, further wherein the pair of wires of each of the plurality of pairs of insulated wires are wrapped around each other within the tubular body regions and not wrapped around each other in the flattened regions;

cutting and separating, with the quick plug connector, the target flattened region of a quick-connect twisted pair cable into two cable segments;

attaching the quick plug connector to the target flattened region of one of the cable segments; and electrically coupling the quick plug connector to one or more insulated wires from the plurality of insulated wires.

5. The method of claim 4, further comprising locking the quick plug connector onto the flattened region of the quick-connect twisted pair cable.

6. The method of claim 4, further comprising removing the portion of the quick-connect twisted pair cable not attached locked onto the quick plug connector.

7. The method of claim 4, further comprising stripping, with the quick plug connector, an insulator from each of the insulated wires of the plurality of pairs of insulated wires.

8. The method of claim 4, further comprising placing the quick-connect twisted pair cable into the quick plug connector.

9. The method of claim 4, wherein closing comprising moving a hinged jaw over the quick-connect twisted pair cable at the target flattened region.

10. The method of claim 4, wherein cutting the target flattened region occurs when the quick plug connector is closed over the quick-connect twisted pair cable.

11. The method of claim 4, wherein making electrical contact comprises driving a plurality of pins in the quick plug connector into the target flattened region, wherein each pin is in electrical contact with a prong of the quick plug connector.

12. A first Ethernet cable segment having a predetermined length and a narrow-diameter connector, the first cable segment comprising:

an Ethernet jack attached to a first end of a plurality of pairs of insulated wires extending within the length of the first cable segment, the Ethernet jack configured to couple to a standard Ethernet port; and a narrow-diameter quick connect connector at a second end of the first cable segment, the narrow-diameter quick connect connector configured to fit within an outer diameter of the first cable segment, wherein the narrow-diameter quick connect connector comprises a plurality of openings or slots, each in electrical communication with one of the insulated wires of the plurality of pairs of insulated wires, and wherein the narrow-diameter quick connect connector is configured to couple with a second cable segment to extend the first cable segment.

13. The first Ethernet cable segment of claim 12, wherein the predetermined length is between 1 m to 20 m.

14. The first Ethernet cable segment of claim 12, wherein the predetermined length is between 0.5 m to 30 m.

15. The first Ethernet cable segment of claim 12, wherein the first cable segment has a diameter at least 3 mm.

16. The first Ethernet cable segment of claim 12, wherein the first cable segment has a diameter of less than 7 mm.

17. The first Ethernet cable segment of claim 12, wherein the plurality of pairs of insulated wires comprises 4 or more pairs of wires.

18. The first Ethernet cable segment of claim 12, further comprising shielding within the narrow-diameter quick connect connector configured to reduce or eliminate electromagnetic interference, noise, spurious emissions, electrical noise, electronic interference.

* * * * *